US009474431B2

(12) United States Patent
Patil et al.

(10) Patent No.: US 9,474,431 B2
(45) Date of Patent: Oct. 25, 2016

(54) SOUND ABATEMENT FOR A DISHWASHER APPLIANCE

(71) Applicant: General Electric Company, Schenectady, NY (US)

(72) Inventors: Avinash R. Patil, Louisville, KY (US); Brandon K G Schaefer, Louisville, KY (US); James Murray Klump, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 130 days.

(21) Appl. No.: 13/950,644

(22) Filed: Jul. 25, 2013

(65) Prior Publication Data

US 2015/0028733 A1 Jan. 29, 2015

(51) Int. Cl.
*A47L 15/42* (2006.01)

(52) U.S. Cl.
CPC ..... *A47L 15/4255* (2013.01)

(58) Field of Classification Search
CPC ..... A47B 77/06; A47L 15/4255; E04B 1/74; D06F 39/14
USPC ..... 181/284, 286, 293
See application file for complete search history.

(56) References Cited

U.S. PATENT DOCUMENTS

| | | | | |
|---|---|---|---|---|
| 4,787,668 | A * | 11/1988 | Kawase et al. | 296/93 |
| 4,946,727 | A * | 8/1990 | Kessler | 428/99 |
| 5,194,312 | A * | 3/1993 | Verig | 428/122 |
| 5,342,107 | A * | 8/1994 | Saji et al. | 296/210 |
| 5,388,371 | A * | 2/1995 | Nozaki | 49/377 |
| 5,566,954 | A * | 10/1996 | Hahn | 277/642 |
| 6,045,203 | A * | 4/2000 | Marks et al. | 312/228 |
| 6,617,015 | B2 * | 9/2003 | Rood | 428/304.4 |
| 6,677,020 | B2 * | 1/2004 | Dron | 428/36.91 |
| 7,252,294 | B2 * | 8/2007 | Yamada et al. | 277/641 |
| 7,281,354 | B2 * | 10/2007 | Nishihara | 49/498.1 |
| 8,015,848 | B2 * | 9/2011 | Colon et al. | 68/3 R |
| 2003/0230955 | A1 | 12/2003 | Welch | |
| 2008/0229670 | A1 * | 9/2008 | Iwasa et al. | 49/490.1 |

FOREIGN PATENT DOCUMENTS

| | | |
|---|---|---|
| DE | 102010002126 | 8/2011 |
| JP | H05130965 A | 5/1993 |

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

A dishwashing appliance is provided having one or more sound abatement features for blocking sound transmission emanating from the appliance during operation. Spaces or gaps present between the dishwashing appliance and the cabinetry in which it is installed can be blocked by features having one or more chambers that attenuate the transmission of sound therefrom. Such sound abatement features can be readily incorporated into the design of a dishwashing appliance and provide a relatively inexpensive alternative to conventional designs.

19 Claims, 7 Drawing Sheets

SOUND ABATEMENT FOR A DISHWASHER APPLIANCE

FIELD OF THE INVENTION

The subject matter of the present disclosure relates generally to a dishwashing appliance and, more particularly, to a dishwashing appliance with one or more features for sound abatement.

BACKGROUND OF THE INVENTION

During the operation of a dishwashing appliance, multiple components are at work as part of the cleaning process—each of which can generate unwanted noise. By way of example, the operation of a pump, the spraying of fluid within the wash chamber, the switching of one or more valves, and other features can generate noise at a level that may be undesirable to some users. At certain times during the cleaning process, these features may be operating at the same time, which can further increase the overall noise level to undesirable levels.

Features have been proposed to reduce the perceived noise level. By way of example, panels equipped with insulated surfaces may be provided to enclose the appliance and reduce the propagation of noise from the appliance. Artificial sound generators have been proposed to cancel the sound created by appliance operation. Noise attenuating seals between the door and the opening to the wash chamber have been attempted.

Unfortunately, certain of the previously described approaches can be complicated in construction and/or expensive to add to a dishwashing appliance. Some users may be willing to accept a higher perceived noise level rather than pay the increased cost of a dishwashing appliance having such noise reducing features.

Accordingly, a dishwashing appliance with one or more improved features for reducing noise would be beneficial. Such as dishwashing appliance having one or more such features that can be implemented relatively inexpensively would be particularly beneficial.

BRIEF DESCRIPTION OF THE INVENTION

The present invention provides a dishwashing appliance having one or more sound abating features for blocking sound transmission emanating from the appliance during operation. The space present between the dishwashing appliance and the cabinetry in which it is installed can be blocked by features having one or more chambers that attenuate the transmission of sound therefrom. Such sound abatement features can be readily incorporated into the design of a dishwashing appliance and present a relatively inexpensive alternative to conventional designs. Additional aspects and advantages of the invention will be set forth in part in the following description, or may be apparent from the description, or may be learned through practice of the invention.

In one exemplary embodiment, the present invention provides a dishwashing appliance that includes a body having a wash chamber for the receipt of articles for washing. The wash chamber has an opening towards a front of the body that provides access inside the wash chamber. The body defines opposing sides extending along a vertical direction and a top side extending along a lateral direction. A sound abating device is connected to the body along the opposing sides and the top side. The sound abating device extends from the body and into contact with cabinetry located adjacent to the top side and the opposing sides. The sound abating device includes a connecting portion for attachment to the body and a baffle portion defining at least one chamber extending longitudinally along the sound abating device at the top and opposing sides.

In another exemplary embodiment, a dishwashing appliance is provided that includes a body having a wash chamber for the receipt of articles for washing. The body has opposing sides extending along a vertical direction and a top side extending between the opposing sides along a lateral direction. A sound abating device is connected to the body along the opposing sides and top side and extends on both opposing sides to a support below the dishwashing appliance. The sound abating device includes a baffle portion defining at least one chamber that extends longitudinally along the sound abating device at the top and opposing sides.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
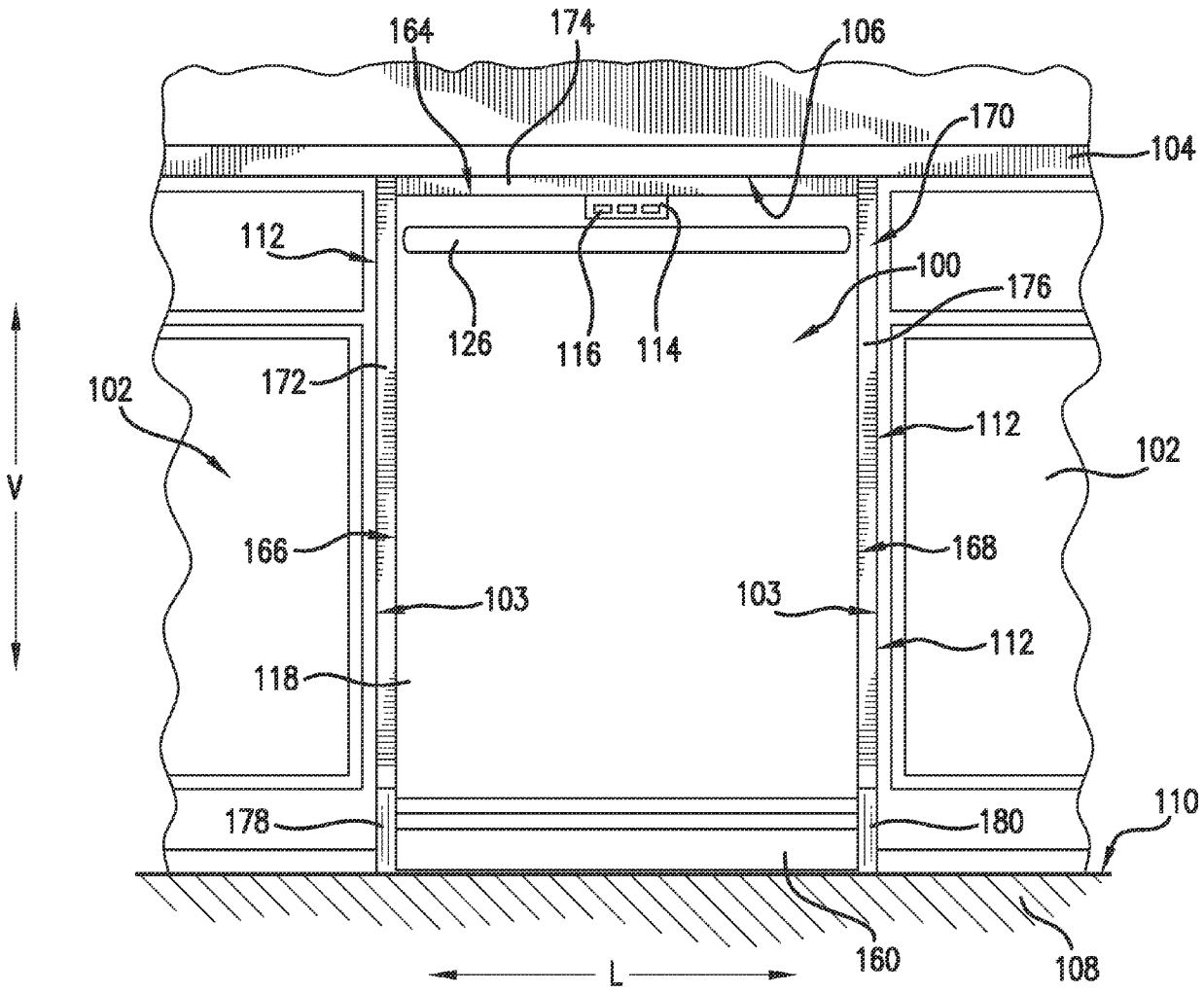
FIG. 1 is a front view of an exemplary embodiment of a dishwashing appliance of the present invention installed within cabinetry.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
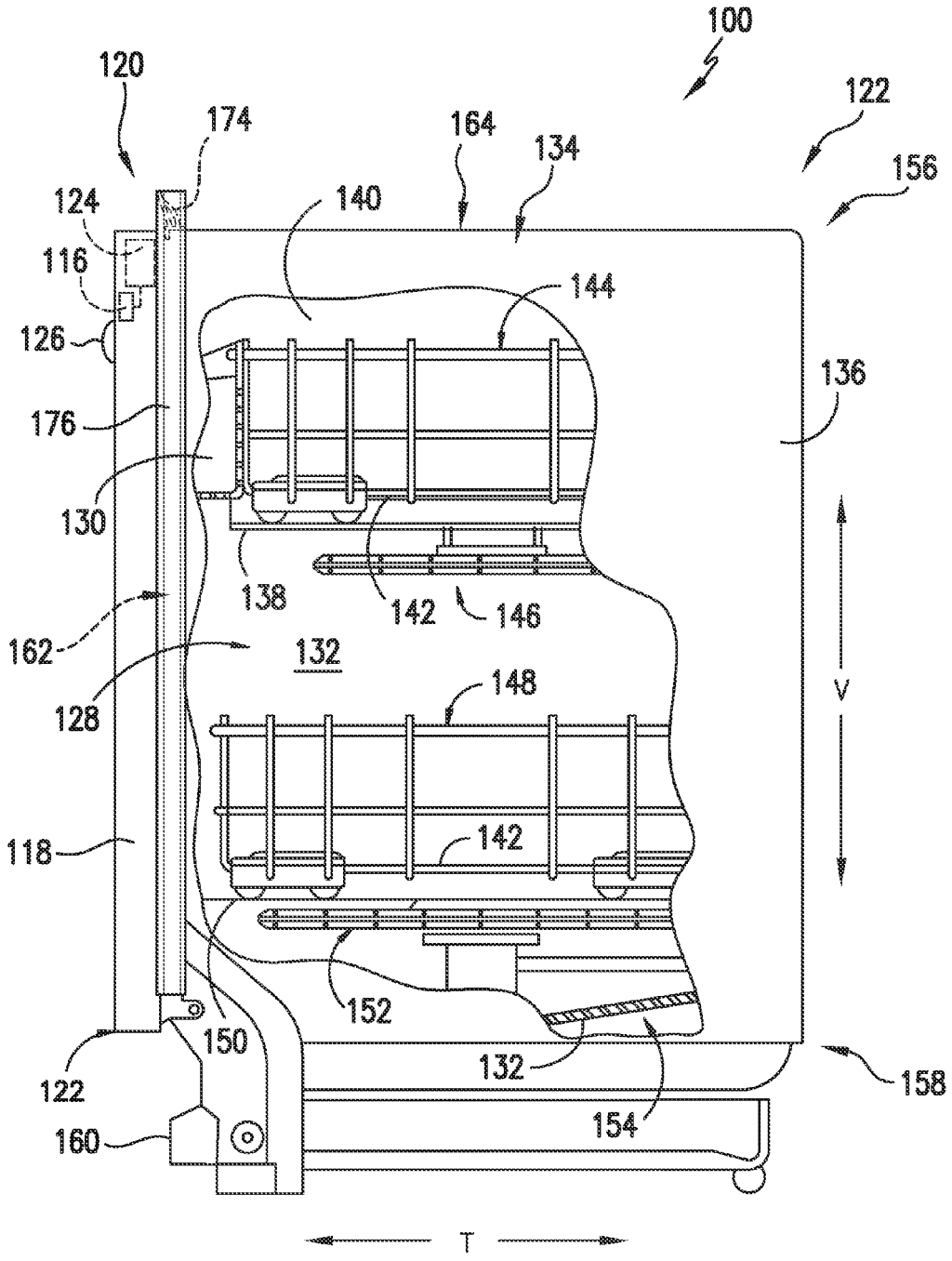
FIG. 2 is a side view of an exemplary embodiment of the dishwashing appliance shown in FIG. 1.
Figure 3:
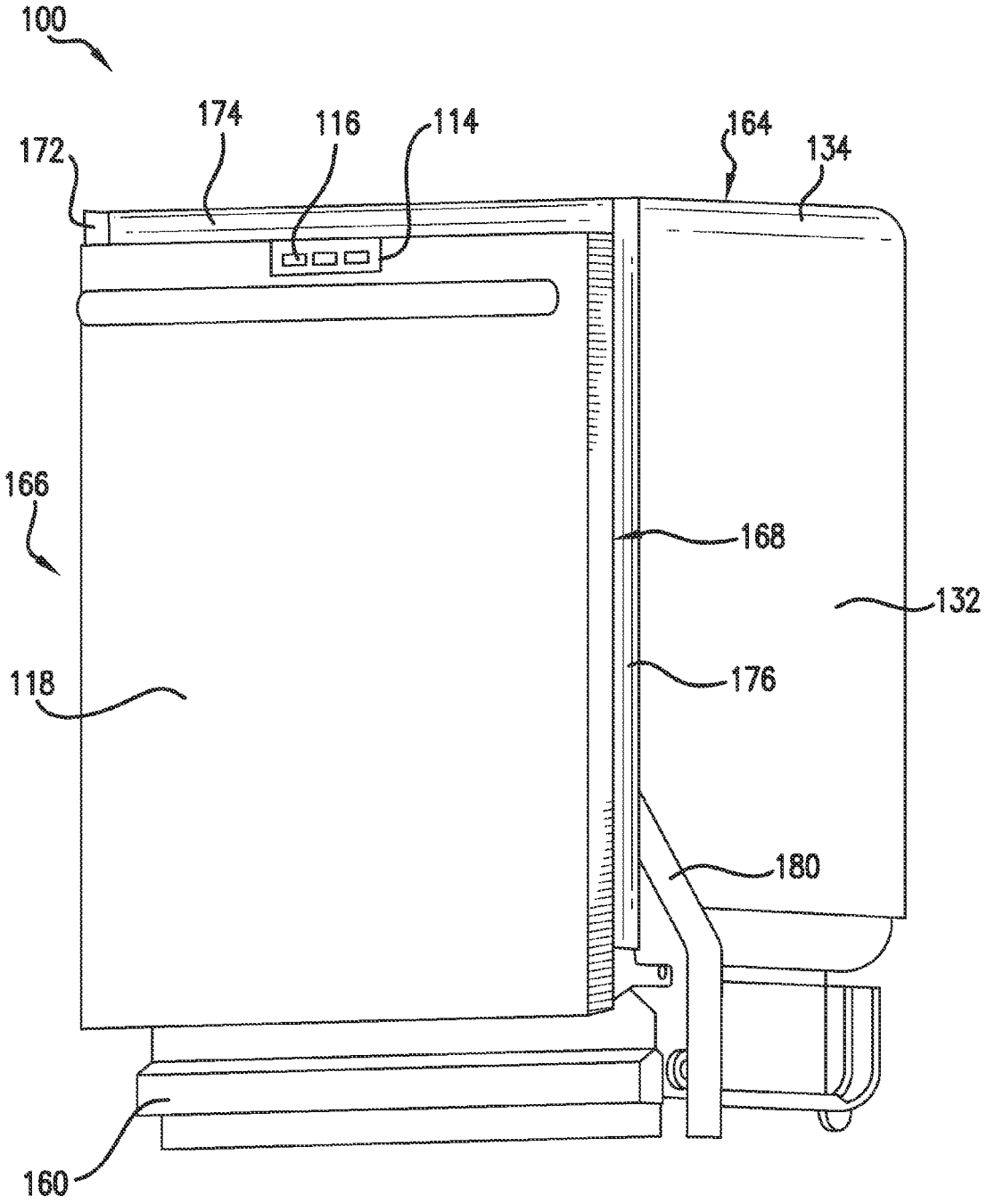
FIG. 3 is a perspective view of the exemplary dishwashing appliance shown in FIG. 1.

FIGS. 1, 2, and 3 depict an exemplary dishwashing appliance 100 of the present invention. Dishwasher 100 is shown in a representative installation within cabinetry 102 and rests upon the top surface 110 of a support or floor 108. More particularly, dishwashing 100 is positioned within an opening 112 defined by cabinetry 102, counter-top 104, and floor 108. Dishwasher 100 and cabinetry 102 are provided by way of example only. The present invention may be used with other appliances and/or cabinetry having a different construction or configuration.

Dishwashing appliance 100 defines a vertical direction V, lateral direction L, and transverse direction T—which are orthogonal to each other. Dishwasher 100 extends along transverse direction T between a front 120 and a back 122, and along vertical direction V between top 156 and bottom 158. A body 134 of dishwasher 100 defines a pair of opposing sides 166 and 168 that extend along vertical direction V and a top side 164 that extends along lateral direction L between opposing sides 166 and 168. For this exemplary embodiment of dishwasher 100, body 134 is shown to include a cabinet 136. However, in other embodiments of the invention, dishwasher 100 may not include a cabinet and could be constructed on e.g., an open frame that defines sides 164, 166, and 168.

A door 118 is hingedly attached to body 134 and provides access to a wash chamber 128 in body 134 through opening 162. A bottom panel 160, located below door 118, covers front access to a machinery compartment 154. Above handle 126, door 118 includes a user interface panel 114 connected to a controller or processing device 124. Buttons 116 allow a user to select different features or cycles of operation of appliance 100. Controller 124 may include a memory and microprocessor, such as a general or special purpose microprocessor operable to execute programming instructions or micro-control code associated with a cleaning cycle. Controller 124 may be positioned in a variety of locations throughout dishwasher appliance 100. User interface panel 114 may include a display component, such as a digital or analog display device designed to provide operational feedback to a user. User interface panel 114 may be in communication with the controller 124 via one or more signal lines or shared communication busses.

Referring specifically now to FIG. 2, guide rails 150 are mounted on side walls 140 of a wash tub 132 defining chamber 128. Guide rails 150 accommodate upper and lower roller-equipped rack assemblies 144, 148. Each of the upper and lower racks 144, 148 is fabricated from lattice structures that include a plurality of elongated members 142. Each rack 144, 148 is adapted for movement between an extended loading position (not shown) in which the rack is substantially positioned outside wash chamber 128, and a retracted position (shown in FIG. 2) in which the rack is located inside wash chamber 128.

A silverware basket 130 is removably mounted to upper rack assembly 144. However, silverware basket 130 may also be selectively attached to other portions of dishwasher appliance 100, e.g., lower rack 148 or door assembly 118. Silverware rack 130 is configured for receipt of silverware, utensils, and the like, that are too small to be accommodated by the upper and lower racks 144, 148.

The dishwasher appliance 100 further includes a lower spray assembly 152 that is mounted within a lower region of the wash chamber 128 and above a sump portion so as to be in relatively close proximity to the lower rack 148. A mid-level spray assembly 146 is located in an upper region of the wash chamber 128 and may be located in close proximity to upper rack 144. Additionally, an upper spray assembly (not shown) may be located above upper rack 144.

The lower and mid-level spray assemblies 152, 146 are fed by a fluid circulation assembly (not shown) for circulating water and dishwasher fluid in wash chamber 128. At least part of the fluid circulation assembly may be located in machinery compartment 154 located below the sump portion of tub 132 as generally recognized in the art. Each spray assembly includes an arrangement of discharge ports or orifices for directing washing liquid onto dishes or other articles located in the upper and lower racks 144, 148 and silverware basket 130. The lower and mid-level spray assemblies 152, 146 may be rotatably mounted in wash chamber 128. Accordingly, the arrangement of the discharge ports may provide a rotational force by virtue of washing fluid flowing through the discharge ports. The resultant rotation of the spray assemblies 146, 152 can provide coverage of dishes and other dishwasher contents with a washing spray.

Dishwashing appliance 100 includes a sound abating device 170 that is connected to body 134 along opposing sides 166, 168 and top side 164. For this exemplary embodiment, sound abating device 170 is constructed from a plurality of resilient strips 172, 174, 176, 178, and 180—the construction of which will be further described herein. While sound abating device 170 could be formed as one continuous strip, for the exemplary embodiment shown, strips 172, 174, 176, 178, and 180 contact each other to form a substantially continuous seal for sound abatement as will be further described. Thus, as shown in FIG. 1, for this exemplary embodiment sound abating device 170 extends in a substantially continuous manner around body 134 and along sides 164, 166, and 168. In addition, sound abating device 170 extends from body 134 into contact with adjacent cabinetry 102. More particularly, sound abating device 170 extends into contact with the bottom surface 106 of counter-top 104 along top side 164. Along opposing sides 166 and 168, device 170 extends into contact with inside cabinetry surfaces 103 defining opening 112. Along opposing sides 166 and 168, sound abating device 170 extends to the top surface 110 of support or floor 108. Sound abating device 170 assists in attenuating the passage of sound generated by dishwashing appliance 100 and transmitted into spaces 212 (FIGS. 5 and 7) between appliance 100 and cabinetry 102 by sealing off the same when appliance 100 is installed in opening 112.

Figure 4:
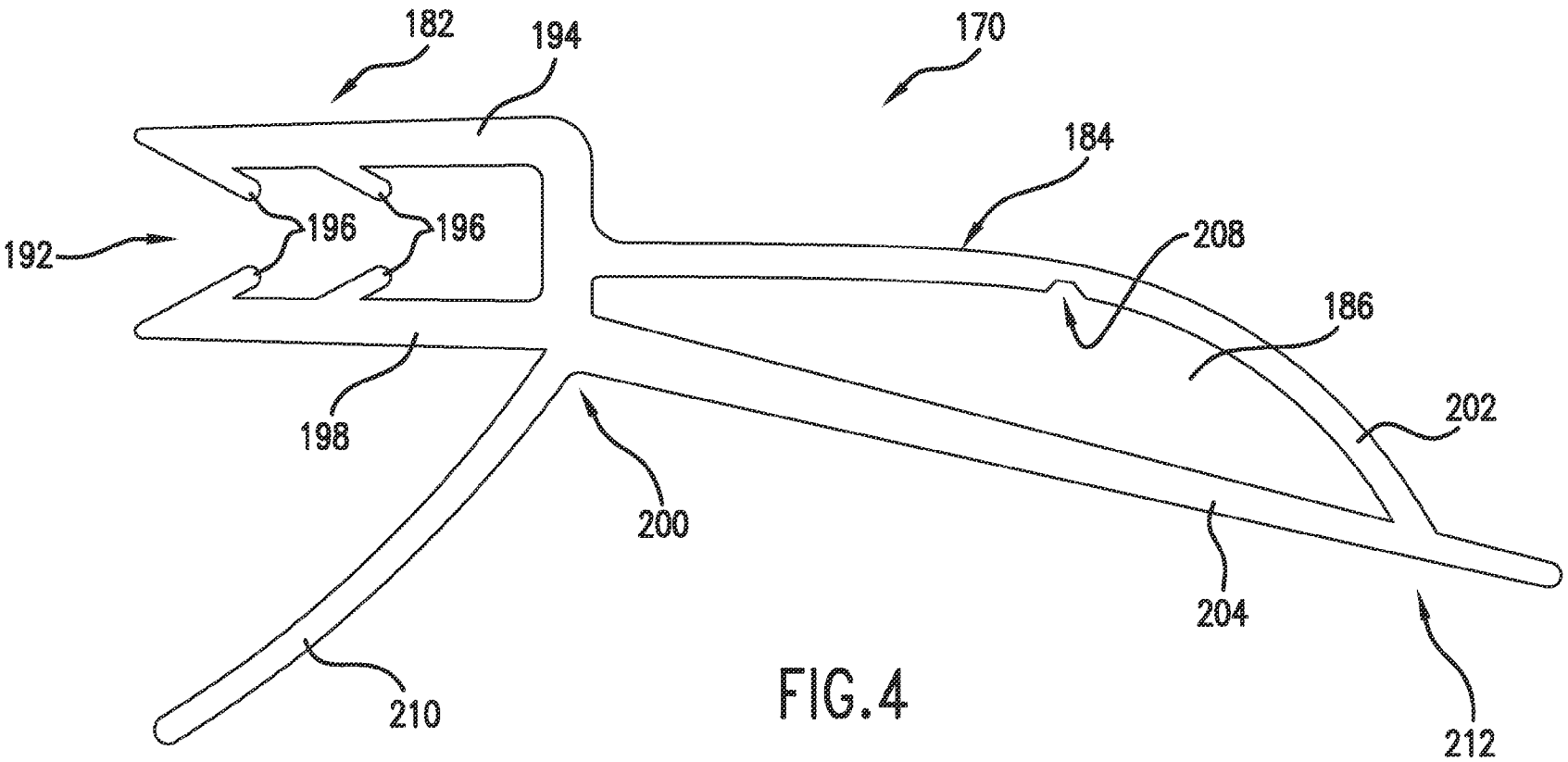
FIG. 4 is an end view of an exemplary embodiment of a sound abating device.
Figure 5:
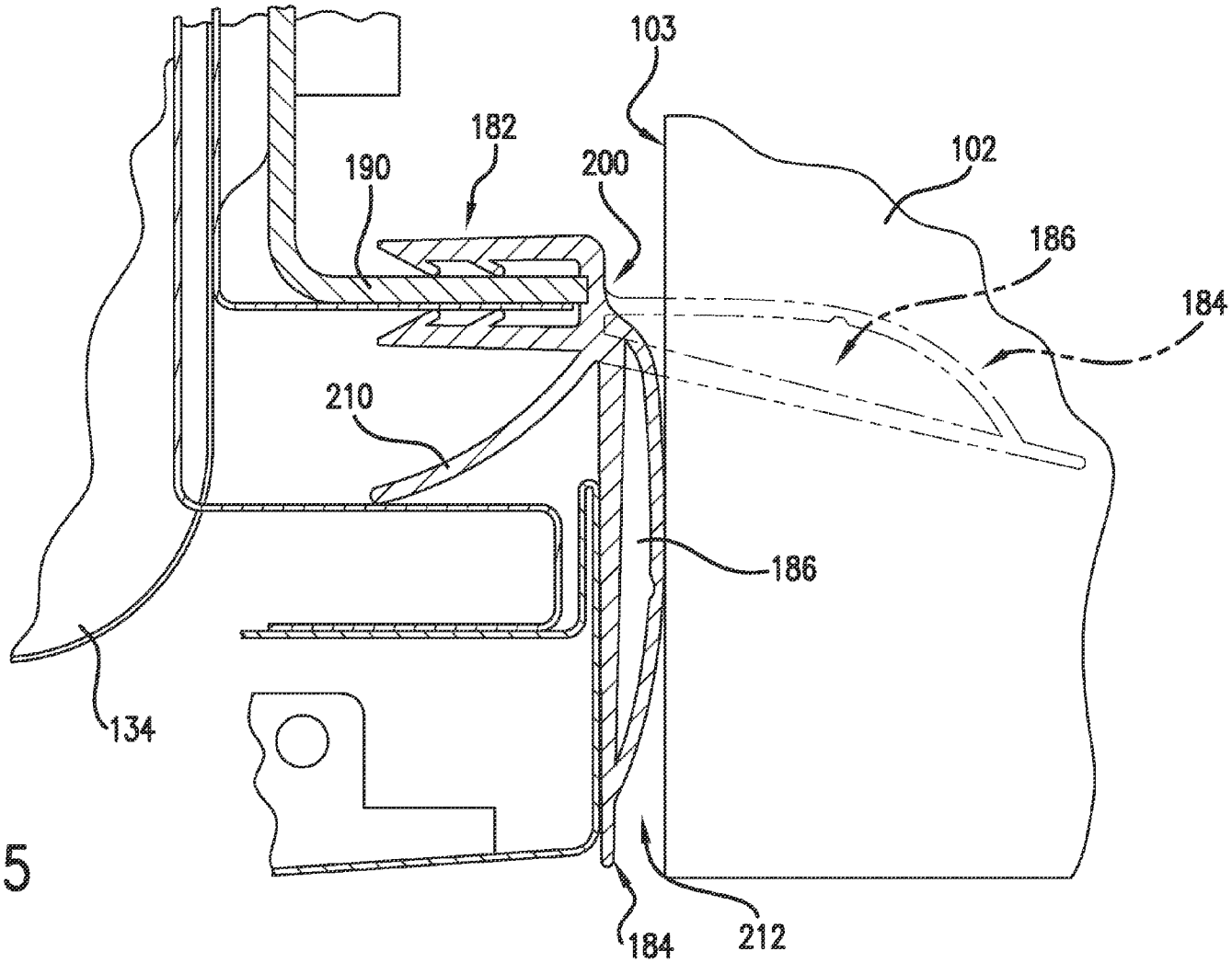
FIG. 5 is a cross-sectional view of the exemplary sound abating device of FIG. 4 as installed within the exemplary dishwashing appliance of FIG. 1.

An exemplary embodiment of sound abating device 170 is set forth in FIG. 4 and shown installed on appliance 100 in FIG. 5. FIG. 4 provides an end view and FIG. 5 provides a cross-sectional view that could be taken anywhere along the length of device 170. In order to attenuate the passage of sound from appliance 100 that is transmitted into the space 212 between appliance 100 and cabinetry 102, device 170 includes a baffle portion 184 as shown in the exemplary embodiment set forth in FIGS. 4 and 5. Baffle portion 184 defines at least one chamber 186 extending longitudinally along sound abating device 170.

Chamber 186 is defined by a first leg 202 and a second leg 204, each of which is attached to a connecting portion 182 along a seam 200. First leg 202 and second leg 204 are also connected along a distal end 212 of device 170. Each leg 202, extends away from connecting portion 182 towards cabinetry 102 and into contact with cabinetry surface 103 when dishwashing appliance 100 is installed. As shown in FIG. 5, by moving dishwashing appliance 100 into the opening 112 of cabinetry 102, sound abating device 170 is folded or bent along seam 200 from an original position (shown in FIG. 5 in phantom lines) to an installed position (shown in FIG. 5 in solid lines). A notch 208 on the inside surface of first leg 202 assists in controlling deformation of chamber 186; multiple notches on legs 202, 204, or both, may be used. Even though baffle portion 184 may be slightly compressed in the installed position, chamber 186 is still present as shown. An optional extension 210 also extends from seam 200.

Chamber 186, along with legs 202 and 204, attenuates the propagation of sound through sound abating device 170. As such, sound abating device 170 reduces or blocks sound created by appliance 100 that is transmitted into the space 212 between appliance 100 and cabinetry 102 and that would otherwise escape into an associated room or space. More particularly, it is believed that sounds generated by different sources in a dishwasher such as appliance 100 are dominated by low frequencies. Low frequency sound is more difficult to attenuate without any barrier. With its single or multi-layer construction (as created by e.g., one or more chambers), the sound abating device of the present invention can be fine-tuned for low frequency sound sources to achieve a higher sound transmission loss. The single or multiple layers of the sound abating device (such as device 170) can be constructed of rubber materials, polymeric materials, poroelastic materials, and/or air layers that result in significant impedance mismatch at their interfaces, causing a higher proportion of sound power to be reflected back. This technical advantage allows for less sound power to reach the consumer. The present invention also provides a commercial advantage over certain conventional devices in that it can be implemented with a small incremental cost through addition to existing parts with a relatively highly significant sound performance gain for the entire dishwasher.

Sound abating device 170 also includes a connecting portion 182 used for attachment to the body 134 of appliance 100. In this exemplary embodiment, connecting portion 182 defines a slot 192 for the receipt of a flange 190 that extends from body 134 along opposing sides 166, 168, and top side 164. Slot 192 extends longitudinally along connecting portion 182. A plurality of fingers 196 extend into slot 192 are configured for securing connecting portion 182 to flange 190.

Figure 6:
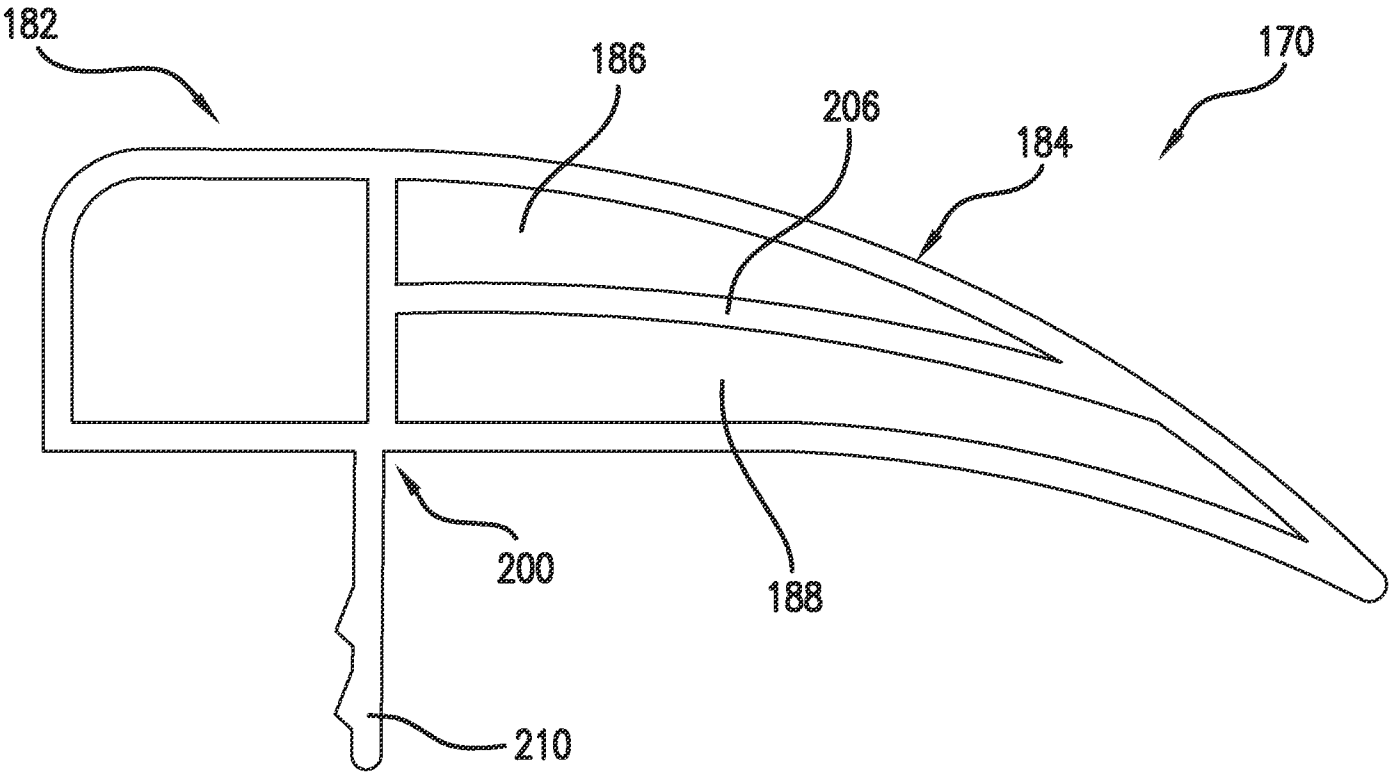
FIG. 6 is an end view of another exemplary embodiment of a sound abating device.
Figure 7:
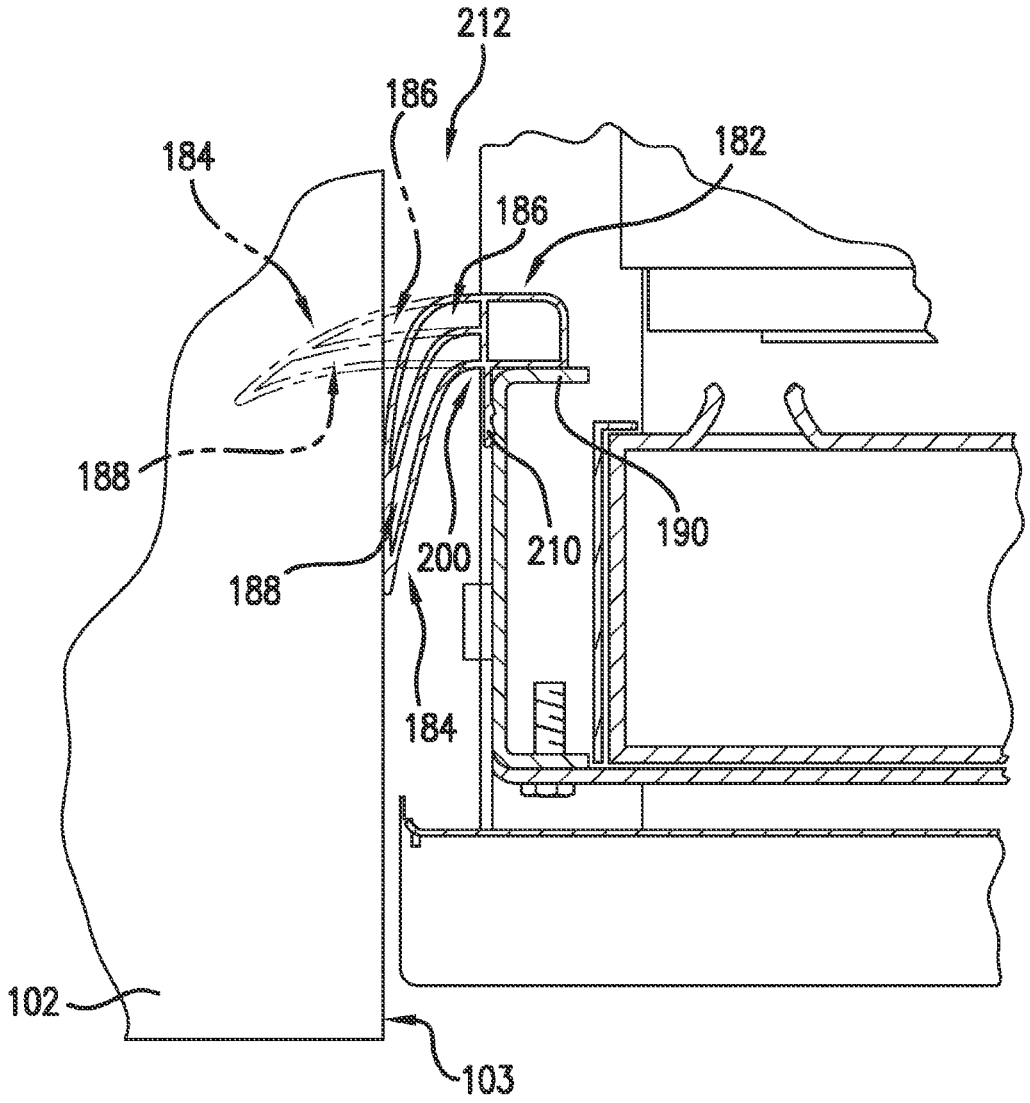
FIG. 7 is a cross-sectional view of the exemplary sound abating device of FIG. 6 as installed within the exemplary dishwashing appliance of FIG. 1.

FIGS. 6 and 7 illustrate another exemplary embodiment of the sound abating device 170 similar in certain respects to the embodiment of FIGS. 4 and 5. However, for the embodiment of FIGS. 6 and 7, sound abating device 170 includes a plurality of chambers 186 and 188. Although only two chambers 186, 188 are shown, in other embodiments of the invention still more chambers may be used. Also, for this exemplary embodiment, connecting portion 182 lacks a slot. Instead, connecting portion 182 is attached by e.g., glue or mechanical fasteners to flange 190. Thus, multiple different techniques and configurations of connecting portion 182 may be used with the present invention.

In one aspect of the invention, materials having different durometers are used in the construction of sound abating device 170. For example, connecting portion 182 has a durometer greater than the durometer of fingers 196. Thus, fingers 196 have a certain flexibility that aids in attachment to flange 190. Similarly, connecting portion 182 has a durometer greater than baffle portion 182 to allow baffle portion to be flexible and bend into space 212 while connection portion has sufficient rigidity to anchor device 170.

A variety of materials may be used in the construction of device 170. For example, one or more extrusion grade poly-vinyl chlorides (PVCs), silicone rubbers, and/or other materials may be used in construction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a body that includes a wash chamber for the receipt of articles for washing, the wash chamber having an opening towards a front of the body that provides access inside the wash chamber, the body defining opposing sides extending along a vertical direction and a top side extending along a lateral direction;

a sound abating device connected to the body along the opposing sides and the top side and extending to a floor, the sound abating device extending from the body and into contact with cabinetry located adjacent to the top side and the opposing sides, the sound abating device comprising a connecting portion for attachment to the body;

a baffle portion defining at least one chamber extending longitudinally along the sound abating device at the top and opposing sides; and a seam extending longitudinally along the sound abating device wherein the baffle portion and the connecting portion are joined, wherein the entire baffle portion pivots relative to the connecting portion by positioning of the dishwashing appliance within cabinetry.

2. A dishwashing appliance as in claim 1, wherein the sound abating device comprises one or more strips of resilient material.

3. A dishwashing appliance as in claim 1, wherein the at least one chamber comprises a plurality of chambers extending longitudinally along the sound abating device at the top and opposing sides.

4. A dishwashing appliance as in claim 1, further comprising:

a flange extending from the body along the opposing sides and the top side, wherein the connecting portion is attached to the flange.

5. A dishwashing appliance as in claim 4, wherein the connecting portion defines a slot extending longitudinally along the connecting portion, wherein the flange is received into the slot.

6. A dishwashing appliance as in claim 5, wherein the connecting portion further comprises a plurality of fingers extending into the slot and configured to secure the sound abating device to the flange.

7. A dishwashing appliance as in claim 6, further comprising the plurality of fingers extending from the connecting portion into the slot defined by the connecting portion, wherein the connecting portion has a durometer greater than a durometer of the plurality of fingers.

8. A dishwashing appliance as in claim 1, wherein the connecting portion has a durometer greater than a durometer of the baffle portion.

9. A dishwashing appliance as in claim 1, wherein the baffle portion comprises:

a first leg attached to the connecting portion and extending away from the connecting portion towards the cabinetry; and a second leg attached to the connecting portion and extending away from the connecting portion, wherein the first leg and second leg are connected along a distal edge of the sound abating device so as to define the at least one chamber there between.

10. A dishwashing appliance as in claim 9, wherein the baffle portion comprises:

a third leg positioned between the first leg and the second leg and extending from the connecting portion so as to define a plurality of chambers between the first leg and the second leg.

11. A dishwashing appliance as in claim 9, wherein the first leg of the baffle portion comprises one or more notches facing the at least one chamber.

12. A dishwashing appliance as in claim 9, wherein the sound abating device comprises one or more resilient strips.

13. A dishwashing appliance as in claim 12, wherein the one or more of the resilient strips comprises at least two PVC materials having different durometers.

14. A dishwashing appliance as in claim 1, wherein the sound abating device form a substantially continuous seal along the opposing sides and the top side to dissipate the transmission of noise.

15. A dishwashing appliance, comprising:

a body that includes a wash chamber for the receipt of articles for washing, the body having opposing sides extending along a vertical direction and a top side extending between the opposing sides along a lateral direction; and a sound abating device connected to the body along the opposing sides and top side and extending on both opposing sides to a support below the dishwashing appliance, the sound abating device comprising a connecting portion and a baffle portion defining at least one chamber that extends longitudinally along the sound abating device at the top and opposing sides, wherein the entire baffle portion pivots relative to the connecting portion by positioning of the dishwashing appliance within cabinetry.

16. A dishwashing appliance as in claim 15, wherein the sound abating device comprises one or more strips of resilient material.

17. A dishwashing appliance as in claim 15, wherein the at least one chamber comprises a plurality of chambers extending longitudinally along the sound abating device at the top and opposing sides.

18. A dishwashing appliance as in claim 15, wherein the sound abating device further comprises a connecting portion for attachment to the body of the dishwasher.

19. A dishwashing appliance, comprising:

a body defining a wash chamber for the receipt of articles for washing and an opening towards a front of the body that provides access to the wash chamber, the body comprising opposing sides extending along a vertical direction and a top side extending along a lateral direction;

a sound abating device connected to the body along the opposing sides and the top side and extending to a floor, the sound abating device extending from the body and into contact with cabinetry located adjacent to the top side and the opposing sides, the sound abating device comprising:

a connecting portion for attachment to the body; and a baffle portion defining at least one chamber extending longitudinally along the sound abating device at the top and opposing sides, the baffle portion comprising:

a first leg attached to the connecting portion and extending away from the connecting portion towards the cabinetry, the first leg comprising one or more notches facing the at least one chamber; and a second leg attached to the connecting portion and extending away from the connecting portion, wherein the first leg and second leg are connected along a distal edge of the sound abating device; and a seam extending longitudinally along the sound abating device wherein the baffle portion and the connecting portion are joined, wherein the entire baffle portion pivots relative to the connecting portion by positioning of the dishwashing appliance within the cabinetry.

* * * * *